US008556788B2

(12) United States Patent
Eisenkolb

(10) Patent No.: US 8,556,788 B2
(45) Date of Patent: Oct. 15, 2013

(54) METHOD FOR MANUFACTURING AN ASSEMBLY OF A FIRST FLEXIBLE SHEET AND A SECOND FLEXIBLE SHEET BY MECHANICAL MEANS

(75) Inventor: Gustaaf Josephus Eisenkolb, Bladel (NL)

(73) Assignee: Securo B.V., Noordwijk Zh Suid-Holland (NL)

( * ) Notice: Subject to any disclaimer, the term of this patent is extended or adjusted under 35 U.S.C. 154(b) by 307 days.

(21) Appl. No.: 12/921,809

(22) PCT Filed: Mar. 11, 2009

(86) PCT No.: PCT/NL2009/050112

§ 371 (c)(1),
(2), (4) Date: Sep. 10, 2010

(87) PCT Pub. No.: WO2009/113851

PCT Pub. Date: Sep. 17, 2009

(65) Prior Publication Data

US 2011/0028294 A1 Feb. 3, 2011

(30) Foreign Application Priority Data

Mar. 13, 2008 (NL) ..... 2001374

(51) Int. Cl.
*B31F 5/00* (2006.01)

(52) U.S. Cl.
USPC ..... 493/231; 493/186; 493/243; 493/245

(58) Field of Classification Search
USPC ..... 493/186, 231, 243, 245
See application file for complete search history.

(56) References Cited

U.S. PATENT DOCUMENTS

| | | | | |
|---|---|---|---|---|
| 2,006,074 | A | 6/1935 | Knight et al. | |
| 3,996,083 | A | 12/1976 | Morgan et al. | |
| 6,308,648 | B1 * | 10/2001 | Burton et al. | 112/475.08 |
| 6,994,043 | B1 * | 2/2006 | Price | 112/475.08 |
| 2001/0020433 | A1 | 9/2001 | Burton et al. | |
| 2007/0113767 | A1 * | 5/2007 | Yip | 112/475.06 |
| 2007/0221109 | A1 * | 9/2007 | Anthony et al. | 112/144 |

FOREIGN PATENT DOCUMENTS

| | | | |
|---|---|---|---|
| FR | 2271157 | A | 12/1975 |
| NL | 1004034 | C1 | 3/1998 |

* cited by examiner

*Primary Examiner* — Hemant M Desai
(74) *Attorney, Agent, or Firm* — Endurance Law Group, PLC

(57) ABSTRACT

A method for manufacturing an assembly of a first flexible sheet and a second flexible sheet by mechanical means, wherein a longitudinal edge of the first flexible sheet is folded over for forming a hem therein, characterized in that said first flexible sheet and said second flexible sheet are mechanically cut to mutually different lengths, with the width of the hem being determined by the difference in length between the first flexible sheet and the second flexible sheet.

4 Claims, 4 Drawing Sheets

METHOD FOR MANUFACTURING AN ASSEMBLY OF A FIRST FLEXIBLE SHEET AND A SECOND FLEXIBLE SHEET BY MECHANICAL MEANS

BACKGROUND OF THE INVENTION

1. Field of the Invention

The invention relates to a method for manufacturing an assembly of a first flexible sheet and a second flexible sheet by mechanical means, wherein a longitudinal edge of the first flexible sheet is folded over for forming a hem therein.

2. Related Art

It is noted that in principle the two flexible sheets may be made of any kind of material, such as textile, rubber, plastic and the like, and that the two flexible sheets do not necessarily have to be made of the same material. However, the material needs to be flexible to such an extent that the first flexible sheet can be folded over. Preferably, the flexible sheets are made of textile material, with the two flexible sheets being made up of cloths, for example cloths for awnings and the like. The second flexible sheet or cloth in particular forms a lining of the first flexible sheet or cloth in that case. The invention in particular relates to the manufacture by mechanical means of a lined curtain, wherein a longitudinal edge of the curtain is folded over for forming a hem therein. It is furthermore noted that within the framework of the invention, the term "hem" is understood to include the English concept "header". The term "header" is a well-known term in the curtain industry, which relates to a folded-over "head" of a curtain.

Such an, albeit necessarily manual, method of manufacturing a lined curtain is generally known. In the known method, part of the lining is cut off manually along a longitudinal edge thereof. The curtain is then folded over on site for forming the hem therein. A strengthening strip may be adhered to the lining before the curtain is folded over on site. Cutting off said part of the lining, for example by means of a pair of scissors, and subsequently folding over the curtain at that location is not only a time-consuming, laborious and inefficient operation, it furthermore has the drawback that said manual cutting generally does not take place sufficiently accurately in practice, so that a hem of an insufficiently constant quality is obtained.

SUMMARY OF THE INVENTION

The object of the invention is to obviate the drawbacks of the prior art, i.e. to manufacture an assembly of a first flexible sheet and a second flexible sheet, in particular a lined curtain, wherein a hem formed therein exhibits a constant quality.

In order to accomplish that object, a method of the kind referred to in the introduction for manufacturing an assembly of a first flexible sheet and a second flexible sheet by mechanical means is according to the invention characterised in that said first flexible sheet and said second flexible sheet are mechanically cut to mutually different lengths, with the width of the hem being determined by the difference in length between the first flexible sheet and the second flexible sheet. The invention is in particular based on the notion that it is possible to control the width of the hem with a high degree of precision along the entire length of the first flexible sheet if said width is determined by the mechanically realised difference in length between the first flexible sheet and the second flexible sheet. Preferably, the first flexible sheet and the second flexible sheet are cut in suspended position (which is possible on account of their flexible nature), so that it is possible to control the cutting of the first flexible sheet and the second flexible sheet (to mutually different lengths) with a high degree of precision along the entire length of the first flexible sheet.

It is noted that the first flexible sheet is preferably formed by a curtain and that the second flexible sheet is preferably formed by a lining for the curtain.

In a preferred embodiment of a method according to the invention, the first flexible sheet and the second flexible sheet are movably suspended prior to being cut. In particular, the first flexible sheet and the second flexible sheet are suspended to be independently movable relative to each other prior to being cut. More in particular, the first flexible sheet and the second flexible sheet are moved from a first parallel position to a second parallel position prior to being cut, with the width of the hem being determined by the distance between the upper edges of the first flexible sheet and the second flexible sheet.

In another preferred embodiment of a method according to the invention, the first flexible sheet and the second flexible sheet are tilted after being cut to mutually different lengths, after which the longitudinal edge of the first flexible sheet is folded over for forming the hem therein. Preferably, the first flexible sheet and the second flexible sheet are tilted in a plane including an angle of between 30° and 90°, preferably between 30° and 60°, with the horizontal. Thus, the folding operation can take place in a controlled manner.

In another preferred embodiment of the method according to the invention, the difference in length between the first flexible sheets and the second flexible sheet is set in advance. This is preferably done by setting the aforesaid distance between the upper edges of the first flexible sheet and the second flexible sheet (which are movably suspended) in advance.

In another preferred embodiment of the method according to the invention, the longitudinal edge of the first flexible sheet is provided with an adhesive prior to being folded over. Thus, the folded-over part of the first flexible sheet is adhesively provided on the second flexible sheet, with the possible interposition of a strengthening strip.

The invention also relates to a device for carrying out a method according to the invention, which device comprises a frame provided with means for cutting the first flexible sheets and the second flexible sheet in suspended position. As already said before, cutting the sheets in suspended position has the advantage that the first flexible sheet and the second flexible sheet can be cut to length in a precise, controlled manner.

In a preferred embodiment of a device according to the invention, said means are provided with a first suspension beam for the first flexible sheet and a second suspension beam for the second flexible sheet, and also with a cutting element for cutting the first flexible sheets and the second flexible sheet in longitudinal direction. In particular, said first suspension beam and said second suspension beam are independently movable in a vertical plane.

In another preferred embodiment of a device according to the invention, the frame further comprises a tiltable table for the first flexible sheet and the second flexible sheet, which table can be tilted between a first, vertical position, in which the first flexible sheet and the second flexible sheet can be cut in suspended position, and a second, inclined position, in which a longitudinal edge of the first flexible sheet can be folded over for forming a hem therein. Preferably, the tiltable table can be tilted between the first, vertical position and the second, inclined position, in which second, inclined position the table includes an angle of between 30° and 90°, preferably between 30° and 60°, with the horizontal.

In another preferred embodiment of a device according to the invention, the frame further comprises (various) clamping means for cutting the first flexible sheet and the second flexible sheet while said sheets are being clamped down.

BRIEF DESCRIPTION OF THE DRAWINGS

The invention will now be explained in more detail with reference to figures illustrated in a drawing, in which.

DETAILED DESCRIPTION OF THE PREFERRED EMBODIMENT

Figure 1:
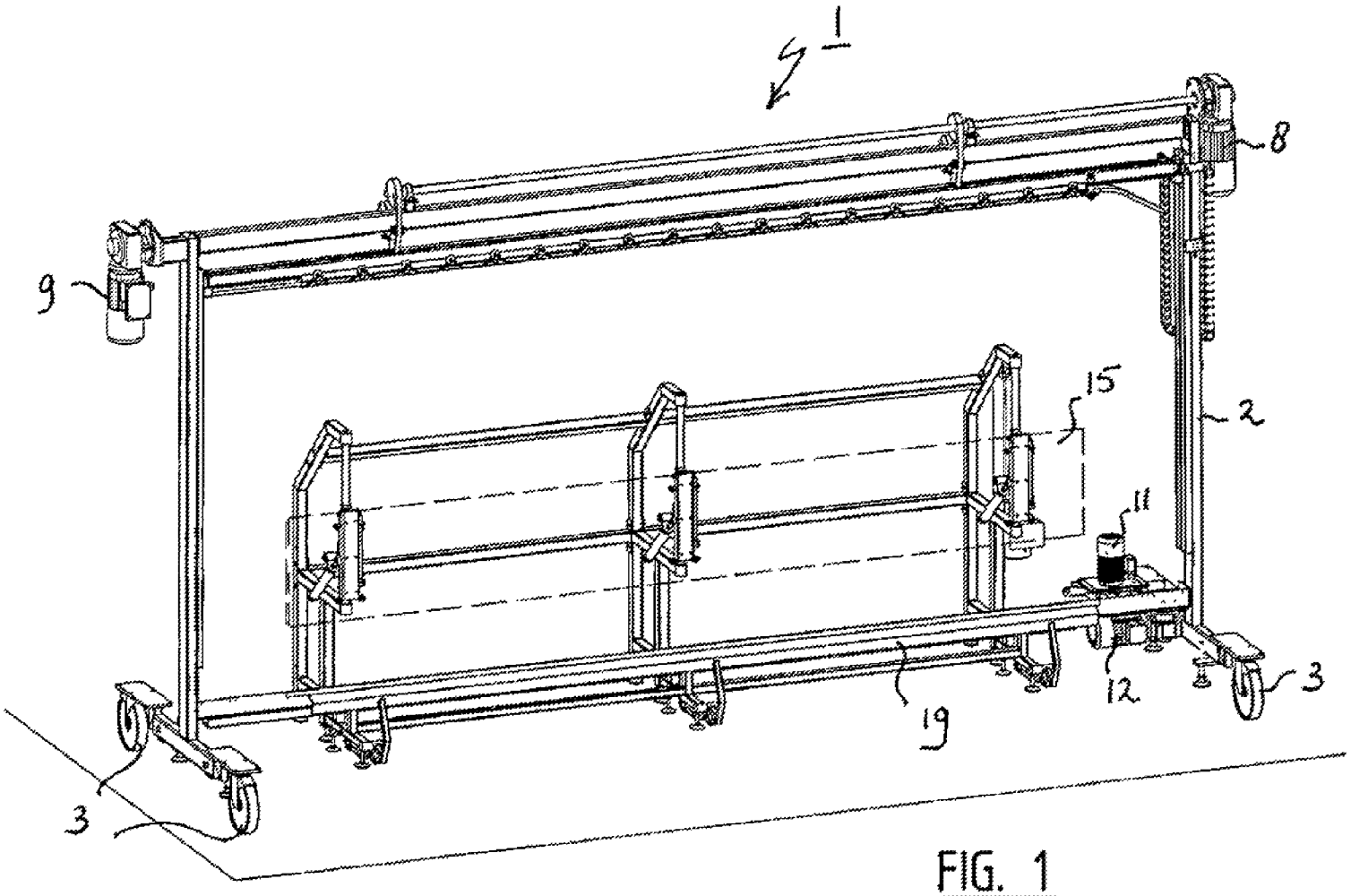
FIGS. 1-6 show steps of the manufacture by mechanical means of a lined curtain provided with a hem according to the invention.

With reference to FIGS. 1-6, there is shown a device 1 for carrying out the method according to the invention, which device 1 comprises a mobile frame 2 on castors 3, which is disposed on a ground surface. The frame 2 further comprises a first suspension beam 4 for a lining 5 and a second suspension beam 6 for a curtain 7. The first suspension beam 4 and the second suspension beam 6 are independently movable in a vertical plane relative to each other by means of electric motors 8, 9.

Figure 3:
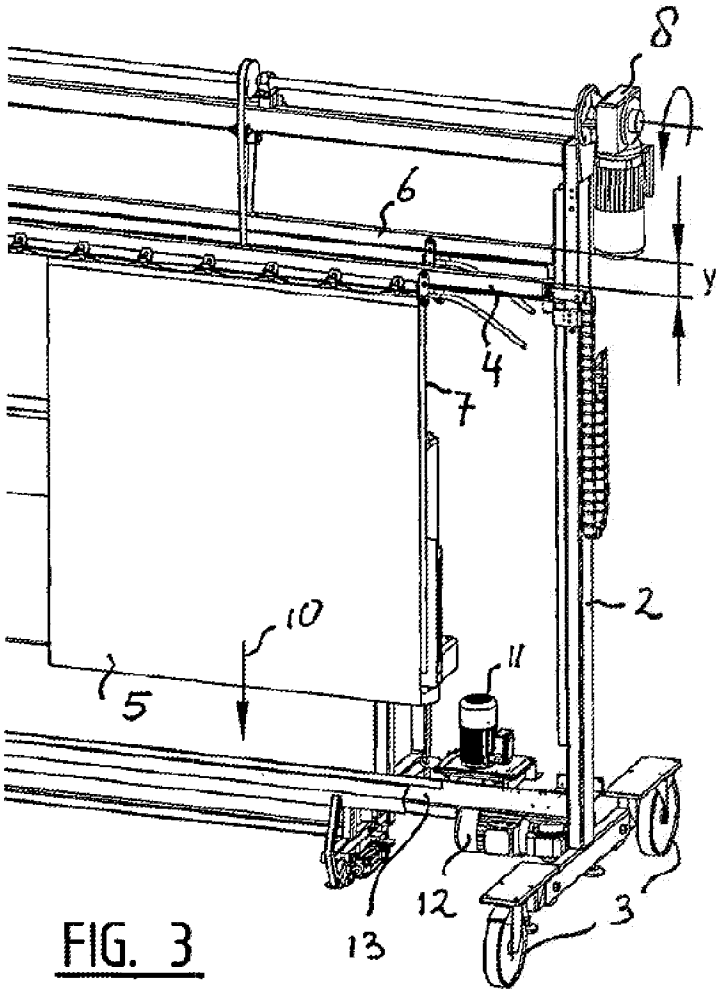
Figure 2:
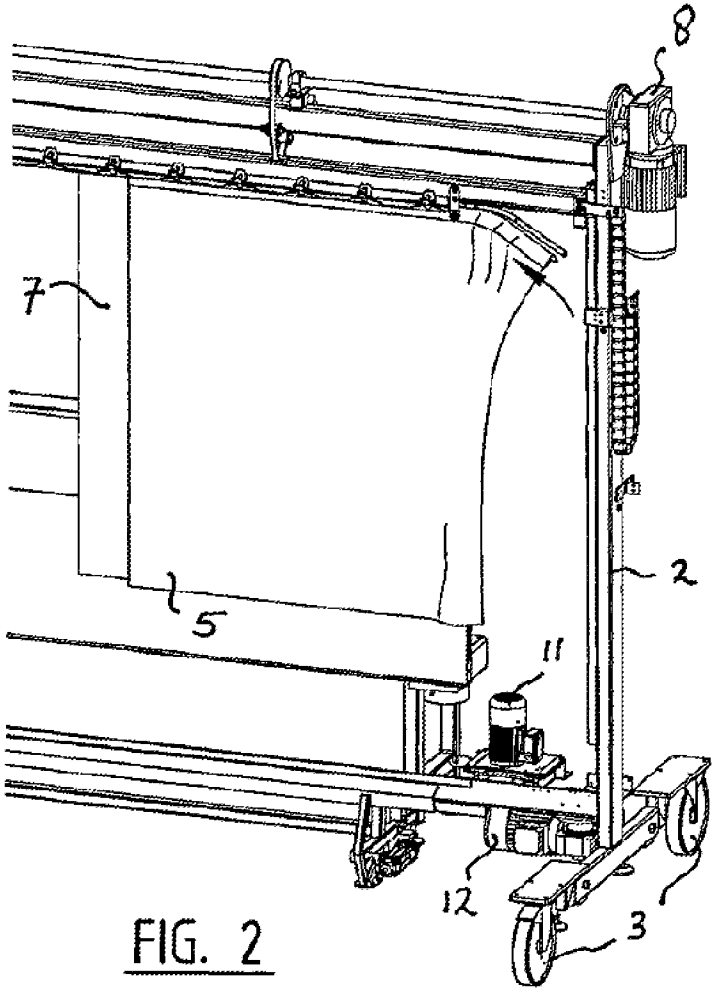
Figure 4:
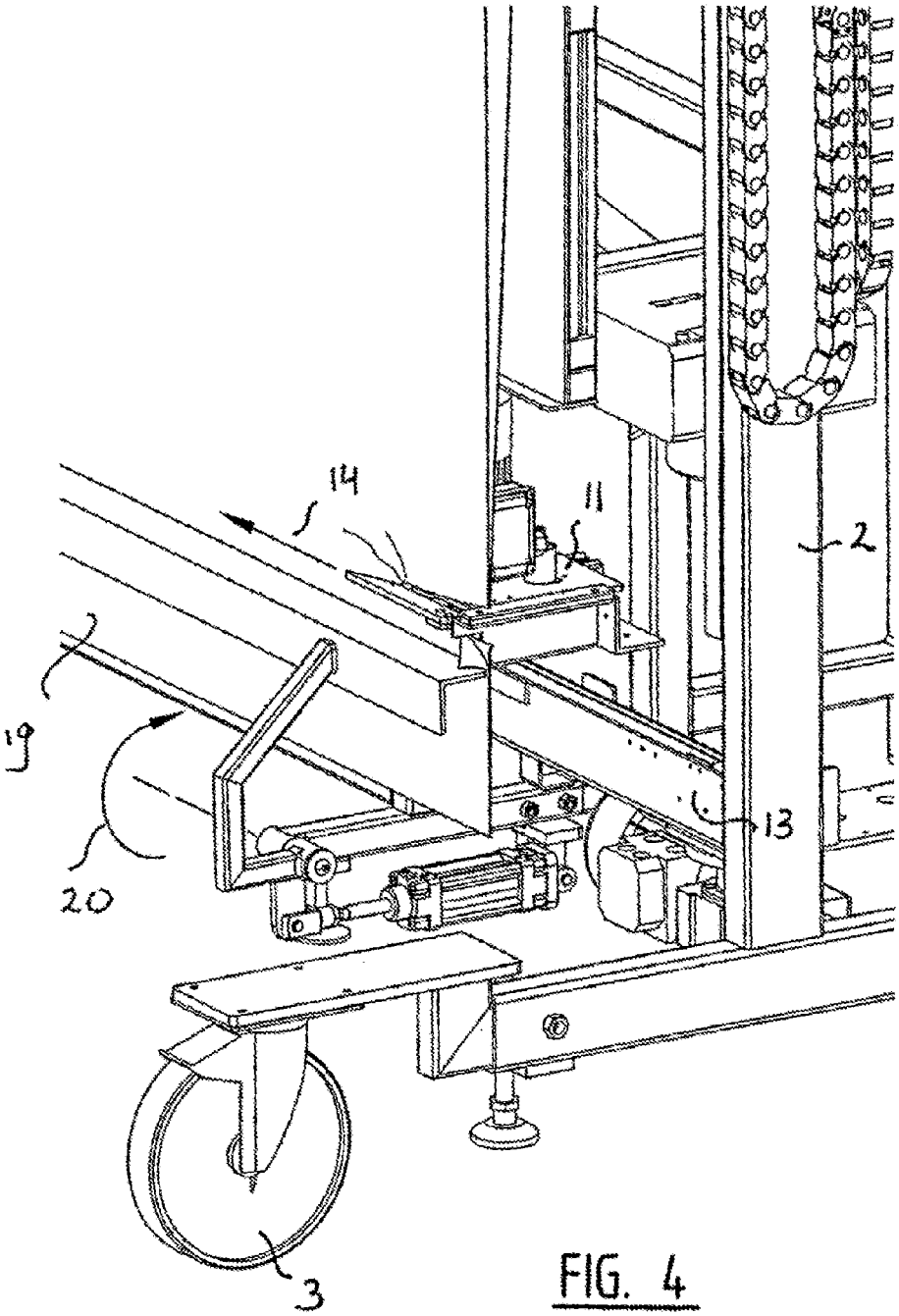

The curtain 7 is first suspended from the second suspension beam 6, whilst the lining 5 is suspended from the first suspension beam 4 (FIGS. 2 and 3). The curtain 7 and the lining 5 are then moved downwards in the direction indicated by the arrow 10 from a first parallel position (FIG. 3) to a second parallel position (FIG. 4). The width of a hem in the lined curtain 7 will eventually be determined by the distance y between the upper edges of the curtain 7 and the lining 5 (FIG. 3). The curtain 7 and the lining 5 are then cut in longitudinal direction to mutually different lengths at their lower edges (in suspended position) by means of a cutting element 11. Said cutting element 11 can be moved along a rail 13 of the frame 2, in the direction indicated by the arrow 14 (FIG. 4), by means of an electric motor 12.

Figures 5, 6:
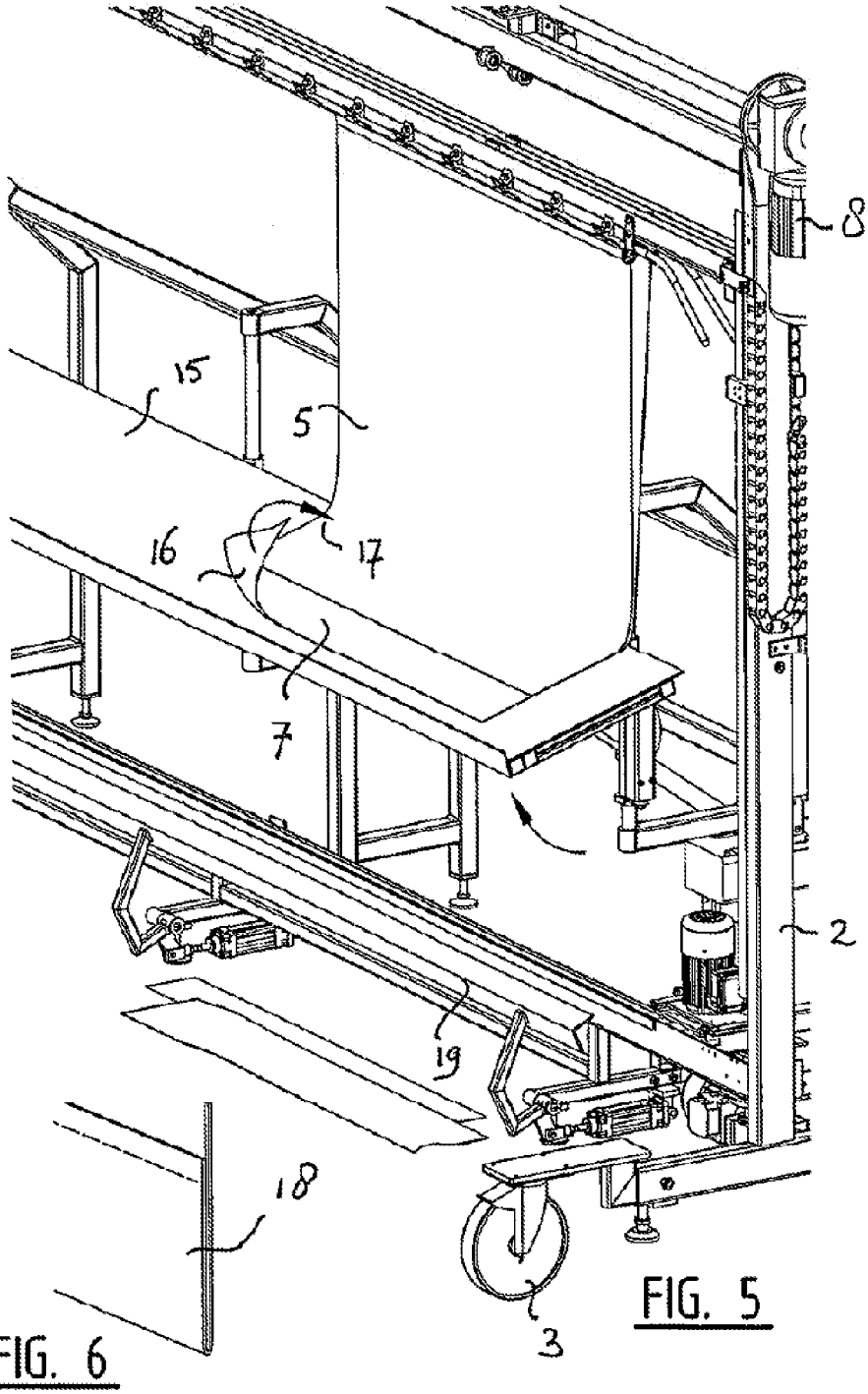

After being cut to mutually different lengths, the curtain 7 and the lining 5 are tilted by means of a tiltable or slanted table 15 (FIG. 5). The curtain 7 and the lining 5 have been moved relative to each other, such that the distance y now manifests itself at the lower edges of the curtain 7 and the lining 5. Using hydraulic or pneumatic means, the table 15 can be tilted between a first, vertical position, in which the curtain 7 and the lining 5 can be cut in suspended position (FIG. 4), and a second, inclined position, in which the longitudinal edge 16 of the curtain 7 can finally be folded over in the direction indicated by the arrow 17 for forming a hem 18 therein (FIG. 6). As shown, the frame 2 comprises several clamping means 19 for cutting the curtain 7 and the lining 5 while clamping down the same, which clamping means 19 are movable in the direction indicated by the arrow 20 (FIG. 4).

The invention is not limited to the embodiments shown herein, but it also covers other preferred variants falling within the scope of the appended claims. Thus, the skilled person will immediately appreciate that the tiltable table 15 may also extend (practically) vertically in the second position thereof (i.e. the position in which the hem is formed).

The invention claimed is:

1. A device for assembling a first flexible sheet and a second flexible sheet, wherein a first longitudinal edge of the first flexible sheet is folded over forming a hem therein, the first flexible sheet and the second flexible sheet are cut to mutually different lengths, with the width of the hem being determined by the difference in lengths, and which device comprises a frame provided with means for cutting the first flexible sheet and the second flexible sheet while both first and second sheets are hung from above in a suspended position, wherein said means are provided with a first suspension beam for the first flexible sheet and a second suspension beam for the second flexible sheet, and also with a cutting element for cutting the first flexible sheets and the second flexible sheet in longitudinal direction, wherein said first suspension beam and said second suspension beam are independently movable in a vertical plane.

2. A device according to claim 1, wherein the frame further comprises a tiltable table for the first flexible sheet and the second flexible sheet, which table can be tilted between a first, vertical position, in which the first flexible sheet and the second flexible sheet can be cut in the suspended position, and a second, inclined position, in which a longitudinal edge of the first flexible sheet can be folded over for forming a hem therein.

3. A device according to claim 2, wherein the tiltable table can be tilted between the first, vertical position and the second, inclined position, in which second, inclined position the table includes an angle of between 30° and 90° with the horizontal.

4. A device according to claim 1, wherein the frame further comprises clamping means for cutting the first flexible sheet and the second flexible sheet while said sheets are being clamped down.

* * * * *